US006533380B1

(12) United States Patent
Hadimioglu et al.

(10) Patent No.: US 6,533,380 B1
(45) Date of Patent: Mar. 18, 2003

(54) METHOD AND APPARATUS FOR REDUCING NEIGHBOR CROSS-TALK AND INCREASING ROBUSTNESS OF AN ACOUSTIC PRINTING SYSTEM AGAINST ISOLATED EJECTOR FAILURE

(75) Inventors: Babur B. Hadimioglu, Mountain View, CA (US); Richard N. Ellson, Palo Alto, CA (US)

(73) Assignee: Xerox Corporation, Stamford, CT (US)

( * ) Notice: Subject to any disclaimer, the term of this patent is extended or adjusted under 35 U.S.C. 154(b) by 0 days.

(21) Appl. No.: 09/954,308

(22) Filed: Sep. 12, 2001

(51) Int. Cl.[7] ..... B41J 2/145; B41J 2/15
(52) U.S. Cl. ..... 347/12; 347/14
(58) Field of Search ..... 347/12, 19, 14, 347/40

(56) References Cited

U.S. PATENT DOCUMENTS

| | | | | |
|---|---|---|---|---|
| 4,812,859 A | * | 3/1989 | Chan et al. | 347/43 |
| 4,908,638 A | | 3/1990 | Albosta et al. | |
| 5,087,931 A | | 2/1992 | Rawson | |
| 5,389,956 A | | 2/1995 | Hadimioglu et al. | |
| 5,541,627 A | | 7/1996 | Quate | |
| 5,589,864 A | | 12/1996 | Hadimioglu | |
| 5,591,490 A | | 1/1997 | Quate | |
| 5,777,637 A | * | 7/1998 | Takada et al. | 347/12 |
| 6,168,261 B1 | * | 1/2001 | Miyake et al. | 347/40 |
| 6,203,140 B1 | * | 3/2001 | Oyen | 347/41 |
| 6,217,147 B1 | * | 4/2001 | Holstun | 347/40 |

FOREIGN PATENT DOCUMENTS

EP 881 082 A2 12/1998

* cited by examiner

*Primary Examiner*—Thinh Nguyen
(74) *Attorney, Agent, or Firm*—Fay, Sharpe, Fagan, Minnich & McKee, LLP

(57) ABSTRACT

An at least two-pass acoustic printing system uses an acoustic printhead having an array of ejectors arranged in rows and columns. Operation of each ejector is individually controllable. To minimize cross-talk errors a first selected ejector in a selected row is identified as an odd ejector of the selected row. Thereafter a first firing sequence of the first selected ejector is generated based on the first selected ejector being identified as odd. Then a second ejector, immediately adjacent the first ejector, is selected and is identified as an even ejector. Thereafter a second firing sequence is generated for the second selected ejector based on the selector being identified as even. The first and second firing sequences result in the first ejector and the second ejector being active during non-concurrent time periods. When a defective ejector of the array is detected, an operable ejector firing to the same substrate area is determined. A firing sequence from or associated with the defective ejector is transferred to be used by the operable ejector wherein the operable ejector fires both its own firing sequence and the firing sequence of the defective ejector.

18 Claims, 7 Drawing Sheets

| | | | | | |
|---|---|---|---|---|---|
| 42 → | $Pixel_1$ | 1 | 0 | 1 | ... 40 |
| 46 → | $Pixel_2$ | 1 | 1 | 1 | ... 44 |
| 50 → | $Pixel_n$ | 0 | 1 | 1 | ... 48 |

FIG. 2

| | $Cycle_1$ | $Cycle_1$ | $Cycle_1$ |
|---|---|---|---|
| $14_{1,1}$ | 1 | 0 | 1 |
| $14_{1,2}$ | 1 | 1 | 1 |
| $14_{1,m}$ | 0 | 1 | 1 |

FIG. 3

| | | |
|---|---|---|
| Row 1 | - | odd |
| Row 2 | - | odd |
| Row n | - | odd |
| Row 1 | - | even |
| Row 2 | - | even |
| Row n | - | even |
| Row 1 | - | odd |
| Row 2 | - | odd |
| Row n | - | odd |

METHOD AND APPARATUS FOR REDUCING NEIGHBOR CROSS-TALK AND INCREASING ROBUSTNESS OF AN ACOUSTIC PRINTING SYSTEM AGAINST ISOLATED EJECTOR FAILURE

BACKGROUND OF THE INVENTION

This invention relates to the deposition of material layers using acoustically ejected droplets, and more particularly to an acoustic printhead system configured to improve droplet placement on a substrate.

For high-quality printing applications such as photo-finishing, it is desirable to have highly accurate spot placement. For example, drop placement should not be more than a few microns from a desired location. Due to these requirements, there is an incentive to minimize the possible contributions to drop misdirectionality. A first such contribution comes from what is known as a nearest neighbor effect or cross-talk. In an acoustic printhead, this problem exists due to sound emitted from a particular transducer along a row, which diffracts as it propagates in the substrate. Some finite amount of sound energy may, under this construction, end up in a neighboring ejector along the same row. This sound field will be focused by the neighboring lens towards or very near the focal point of the neighboring lens. The acoustic field, due to cross-talk, will have a slightly different phase compared to the main beam due to the difference in propagation paths. It has been observed that under these circumstances (i.e. a main beam and a secondary field with a slightly different phase) the drops come up from the liquid at a slight angle to the main sound beam. This undesirable secondary field causes a misdirectionality which may not be acceptable for high-quality printing, such as for photo-finishing.

Another defect which is undesirable in high-quality printing applications is the failure of even a single acoustic printhead ejector or jet. The failure of a single acoustic printhead ejector, may result in an undesirable printhead signature such as a white line on the printed substrate.

The present invention mitigates the issue of cross-talk between adjacent ejectors and that of severe printhead signatures arising from defective or improperly operating ejectors.

SUMMARY OF THE INVENTION

An at least two-pass acoustic printing system uses an acoustic printhead having an array of ejectors arranged in rows and columns. Operation of each ejector is individually controllable. To minimize cross-talk errors a first selected ejector in a selected row is identified as an odd ejector of the selected row. Thereafter a first firing sequence of the first selected ejector is generated based on the first selected ejector being identified as odd. Then a second ejector, immediately adjacent the first ejector, is selected and is identified as an even ejector. Thereafter a second firing sequence is generated for the second selected ejector based on the selector being identified as even. The first and second firing sequences result in the first ejector and the second ejector being active during non-concurrent time periods. When a defective ejector of the array is detected, an operable ejector firing to the same substrate area is determined. A firing sequence from or associated with the defective ejector is transferred to be used by the operable ejector wherein the operable ejector fires both its own firing sequence and the firing sequence of the defective ejector.

BRIEF DESCRIPTION OF THE DRAWINGS

FIG. 2 is a chart for a number of acoustic drop ejection sequences;

FIG. 3 sets forth the operational states of drop ejectors corresponding to drop ejection sequences;

DETAILED DESCRIPTION OF PREFERRED EMBODIMENTS

Forming of images on a substrate may be accomplished by various printing technologies. These include thermal ink-jet, piezoelectric, as well as acoustic printing. While the present discussion will focus on acoustic printing, it is to be appreciated that aspects of the invention are applicable to other forms of printing, as well as other forms of drop ejection, such as the ejection of bio-fluids by either acoustic, piezoelectric, thermal jet or other technologies.

Acoustic printheads are favorably used in high quality printing applications such as photo-finishing as it is possible fabricate large numbers of densely packed droplet ejectors in small areas.

Individual ejector and printhead operation and construction has been well documented in the art, and therefore will not be discussed in great detail. However, it suffices to say that a conventional acoustic printhead ejector will include a liquid channel formed in a channel forming layer. A Fresnel or other lens may be used on the surface of a glass substrate where the channel is formed and is bonded to the substrate such that the Fresnel lens is within the liquid channel. An opening to the channel is formed on a top surface and during normal operation, the liquid fills the channel to form the free surface of the liquid. A piezoelectric device is positioned on an opposite side of the substrate from the channel, including at least two electrodes and a piezoelectric layer. When a radio frequency (RF) signal from an RF source is applied between the electrodes, the piezoelectric device generates acoustic energy in a substrate directed toward the ink channel. The Fresnel lens focuses the acoustic energy entering the channel from the substrate onto the liquid-free surface. The acoustic energy causes a droplet to be expelled from the channel to a medium.

Figure 1:
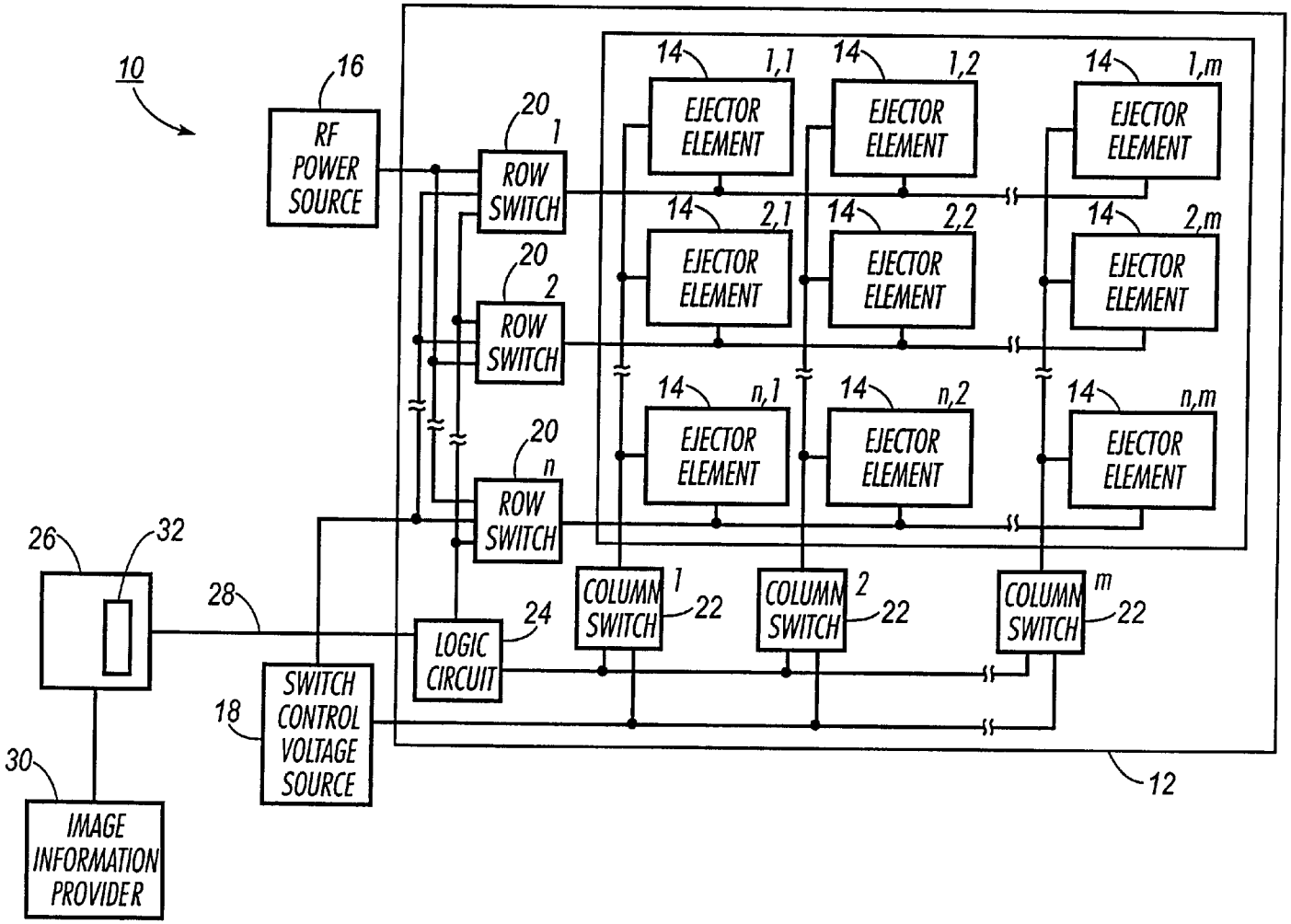
FIG. 1 is a block diagram of an acoustic printing system including an array of ejectors for a high-density printhead.

Individual ejectors are formed, as previously noted, in densely packaged printheads. An acoustic printhead system 10, including a printhead 12, having an array of acoustic ejector elements 14 is shown in FIG. 1. Each ejector element 14 is referenced by the corresponding row and column numbers. The ejector element 141,1 is the top left ejector element 14, while the ejector element 14n,m is the lower right ejector element 14, and where the first subscript represents the row and the second subscript represents the column.

Printing system 10 further includes an RF power source 16, and a DC control voltage source 18. RF power and control signals are switched by an array of row switches 20 and column switches 22, respectively, for supplying the signals and power to individual ejectors 14. A logic circuit 24 receives commands from a printer controller 26 through signal line 28. Each ejector element 14 is activated by turning on one of the row switches 20 and one of the column switches 22. The row switches 20 connect and disconnect the RF power source 16 to and from a row of the ejector elements 14. A pulse switch control voltage source 18 functions to turn on the column and row switches. Accordingly, the logic circuit 24 selects ejector 141,1 by turning on switches 201 and 221. When ejector 141,1 is selected, the other ejector elements 14 of column 1 and rows 2–n are not selected because the RF power source is disconnected by row switches 202–20*n*. The ejector elements 14 of row 1 in columns 2–m are also not selected, since these ejector elements 14 are switched off by column switches 222–22*m*. Because of the leakage of the RF current from their column switches, however, these ejector elements receive some RF power. But they do not generate sufficient acoustic energy to eject droplets.

There is no restriction that only one ejector 14 may be turned on at any one time. Depending upon how the printhead 12 is configured, one sweep across the recording medium may cover multiple printing objects that require multiple ejectors 14 to eject liquid. For this situation, the logic circuit 24 may turn on one row switch 20 and multiple column switches 22.

Supplying the RF power signal to the rows and the DC control signal to the columns reduces the number of switches 20,22 required for the array of the ejector elements 14, and the peak power required from the RF power source 16. During printing, the rows are supplied with the RF power signal from the RF power source 16 sequentially, so that at any one time, only one row is connected to the RF power source. Since there are n rows, a maximum of m ejectors can be on at any one moment. Thus, the RF power source 16 needs to be able to supply power to at most m ejectors 14 during each print cycle, instead of all the possible n×m ejectors 14 on the printhead. Organizing the switches 20 and 22 to switch rows and columns also obviates the need to have one switch per ejector element 14. Since there are n rows and m columns, only n+m switches are needed instead of n×m.

Logic circuit 24, as well as switches 20 and 22 may be manufactured using thin film, poly or amorphous silicon on the same glass substrate, as the elements making up the individual ejectors. This integration reduces the number of wires required to connect the printhead to external electronics, leading to low manufacturing cost and a highly dense printhead. Furthermore, the ability to manufacture logic devices directly on the printhead allows for the integration of more intelligence onto the printhead and consequently, reduces the complexity of the printer controller 26.

In one embodiment, an image information provider 30 such as a computer, scanner, digital imaging device, xerographic imaging device or other known image transferring system provides data to printer controller 26. Printer controller 26 may include a lookup table (LUT) 32 as well as other image processing components which are well known in the art. The image data from image data source 30 supplies the printer controller 26 with information as to the number of drops to be fired for each pixel on a substrate where an image is to be formed. The printer controller translates the number of drops to be fired for a pixel into a firing sequence for that particular pixel and stores data from this sequence in a look-up table (LUT).

In a single-pass printhead system, a single ejector fires all the drops for a single pixel. However, in two-pass or multiple-pass printhead systems, more than a single ejector may have responsibility for ejecting droplets to a particular pixel. Two or multiple-pass systems are used to beneficially minimize certain printhead signature defects or imperfections. For example, if a printhead has a certain characteristic and it is used to print all the drops for a particular pixel, the printhead signature would become very obvious to an observer. However, by using two or more ejectors for a particular pixel, this signature defect issue is minimized.

To provide an understanding of the present invention, a simplified discussion of system operation will now be undertaken.

As previously noted, data supplied by image information source 30 is translated, by printer controller 26, into a firing sequence. The obtained firing sequence is then loaded in LUT 32. For example, as shown in FIG. 2, a firing sequence 40 may be generated for a first pixel 42, a firing sequence 44 for a second pixel 46, and a third firing sequence 48 for a nth pixel 50. It is to be appreciated that these are simply portions of firing sequences which may be necessary for a particular pixel. Also, a pixel is used in this sense as the area on the substrate where fluid is to be supplied by a selected ejector or ejectors. Printer controller 26 and logic circuit 24 use these firing sequences to control the hardware to eject liquid droplets from ejectors 14. As may be seen in FIG. 3 for example, in this simplified example, the firing sequence for pixel 1 may be determined to control the operation of ejector 141,1. The firing sequence 44 for pixel 2 may be used to control the firing sequence of ejector 141,2 and the sequence 50 for pixel 3 may be used to control operation of ejector 141,m. What is noticeable in FIG. 3 is that during a first ejector addressing cycle for a first row of printhead 12, both ejector 141,1 and ejector 141,2 will be active at the same time. Similarly, a second ejector addressing cycle will result in ejector 141,2 and ejector 141,m also on at the same time. It is this type of sequencing that results in cross-talk misdirectionality errors of droplets being ejected. FIG. 3 also illustrates that a third addressing cycle has all ejectors active at the same time. It is to be appreciated that with reference to ejector 141,2 since ejector 141,1 and ejector 141,m are also on, there is a canceling effect at least as to ejector 141,2 which eliminates misdirectionality that would otherwise exist due to cross-talk.

In existing acoustic printhead systems, it is known that the peak drop ejection rate for aqueous inks is approximately 48 kHz. In other words, this is the chaotic limit for aqueous inks such that an acceptable level of drop ejection and directionality is achievable. Operation above this rate leads to observable levels of misdirection and undesirable outputs. To maintain a high level of image quality, acoustic printer systems have limited the ejection to a first or normal frequency of 24 kHz or less in order to maintain high quality image printing such as for photo-finishing. It is to be appreciated that other peak drop ejection frequencies exist for different fluids, and that the present invention is applicable to these other fluids. Particularly the present invention is not limited to uses at 24 kHz and the 48 kHz discussed below, but is also applicable to other ranges.

With attention to an aspect of the present invention, the inventors take advantage of the 50% operation rate, i.e., 24 kHz, used in acoustic printer systems. Therefore in this embodiment, where present systems are for addressing the rows of a printhead at a 24 kHz rate, the present invention increases the operation of RF power source 16 and DC control voltage source 18 to function in a manner to supply row addressing signals at 48 kHz.

Figure 4:
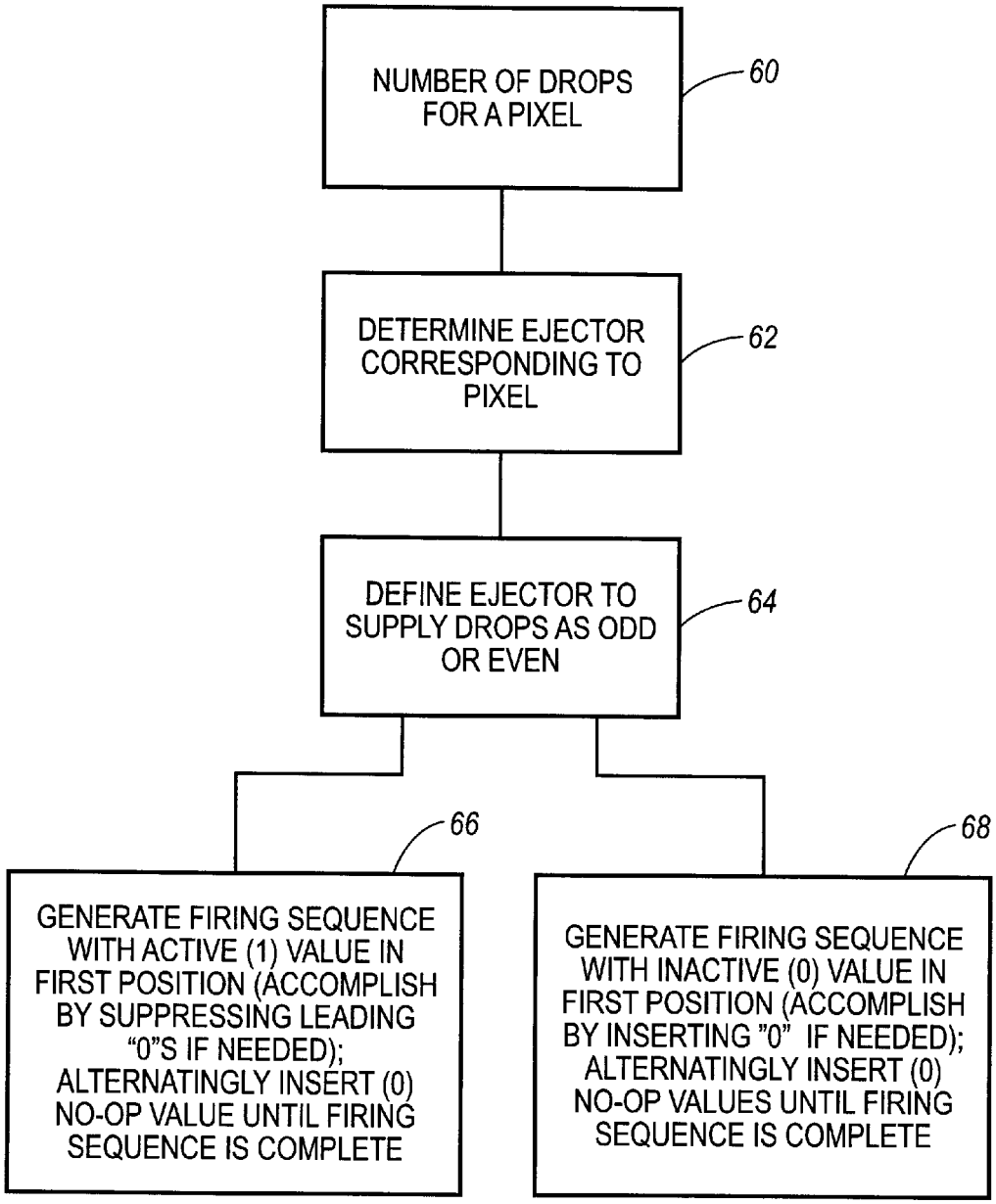
FIG. 4 is a flow chart setting forth the manner of generating a drop ejection sequence in accordance with the present invention.

The present invention then controls ejection operation such that ejectors that are adjacent in a same row are not fired during the same address firing cycle. Different procedures may be used to accomplish the task of having the printer controller and look-up table 32 ensure this outcome. One such simple algorithm is shown in FIG. 4, where the number of drops for a particular pixel are determined 60. This information is received normally from the image information system 30 of FIG. 1. A correlation is then made as to which ejector is to supply the drops for the corresponding pixel 62. It is next determined whether that ejector is designated as an even ejector or an odd ejector within its row 64. This is accomplishable by designating the defined ejectors via any known counting strategy.

In step 64, when it is determined that the ejector supplying the drops is an "odd" ejector, the firing sequence is configured with an active state (1) in the first position. Thereafter, an inactive state is alternatingly inserted within the positions of the sequence until all drops to be placed within the pixel are accounted for 66. Similarly when an "even" ejector is determined, a firing sequence is generated starting with an inactive (0) firing data in the first position. Thereafter, inactive or non-operational states are alternatingly inserted within the firing sequence positions until all drops are accounted for in that particular pixel 68. Firing sequences formed from either step 66 and/or step 68 are then for controlling the hardware of the printhead system. This process of FIG. 4 may be repeated for all pixels of the image.

Figures 5, 6:
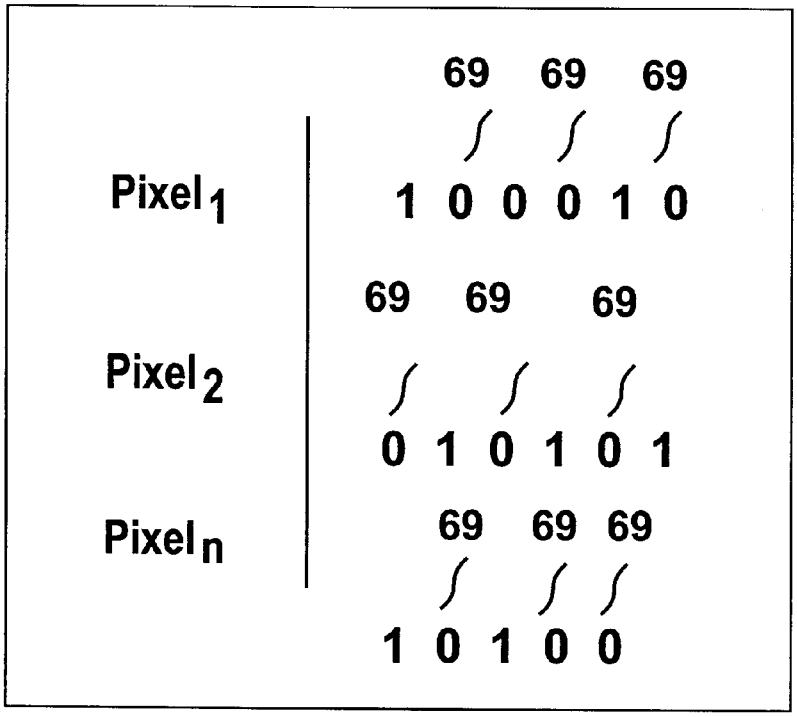
FIG. 5 depicts newly generated drop ejection sequences usable in the present invention.
FIG. 6 sets forth a generalized graph showing sequences through the rows of a printhead and the ejectors ejected during each addressing of a row.

Using the process shown in FIG. 4, the drop sequences for pixels (pixel1–pixeln) of FIG. 3 would appear as shown in FIG. 5 (where pixel n is assumed to be addressed by an odd ejector). What may be noticed in FIG. 5, is that whereas in FIG. 2 only three drop-ejector addressing cycles were necessary, in FIG. 5, up to six or twice as many addressing cycles are needed to emit the number of required drops per pixel. The additional firing cycles exist due to the insertion of the non-active insertions 69.

However, as was previously noted, the present invention doubles the row addressing speed. Therefore, the overall speed of printing is substantially equivalent to that of prior art systems. Again, the doubling of the addressing speed allows for the sending of power to a row of ejectors at about a 48 kHz rate but only turning on at most about half of the ejectors at a time. Alternating the firing of a given ejector between row powering gives the ejector firing a frequency of 24 kHz, thus both eliminating the visual artifact caused by acoustic cross-talk and maintaining the desired lower ejector repetition rate.

Thus, in a more generalized sense and as shown in FIG. 6, when row 1 is addressed, it will initially fire the odd ejectors, then sequencing through to row 2 through row n, the odd ejectors of these rows will also be fired. Thereafter, the addressing cycle will return to row 1, and again sequence through to row n firing the even ejectors. This process continues, through a sequencing between rows 1–n and between odd and even ejectors until the ejector addressing cycles allotted in the operation have been completed. For instance, in FIG. 5, there are six ejector addressing states, even though at most there are three drops to be ejected. In this situation, the doubling of the ejector addressing states permits a situation where no two ejectors physically adjacent in a row are active at the same time. Under this scenario, the row addressing processes will cycle through each of the rows six times as opposed to the three times which would have been possible not using or implementing this system. These additional firing sequences do not increase the overall printing time due to the doubling or otherwise increasing of the row addressing frequency. In this embodiment while a doubling of the addressing cycle is described, other ratio may be used when appropriate.

With attention to another aspect of the present invention, current print architectures for acoustic printers tend to rely on more than a single ejector from a printhead to fill a pixel area, and no ejector is running faster than at half a peak ejection rate. The systems tend to use multiple passes to assist in hiding mild forms of printhead signature such as optical density variations, due to drop volume variations, and ejector misdirectionality. Existing two-pass systems are not adequate to cover more severe printhead defects such as an ejector which places a drop out of its intended area by over half a pixel or an ejector which is not active at all.

Figure 7:
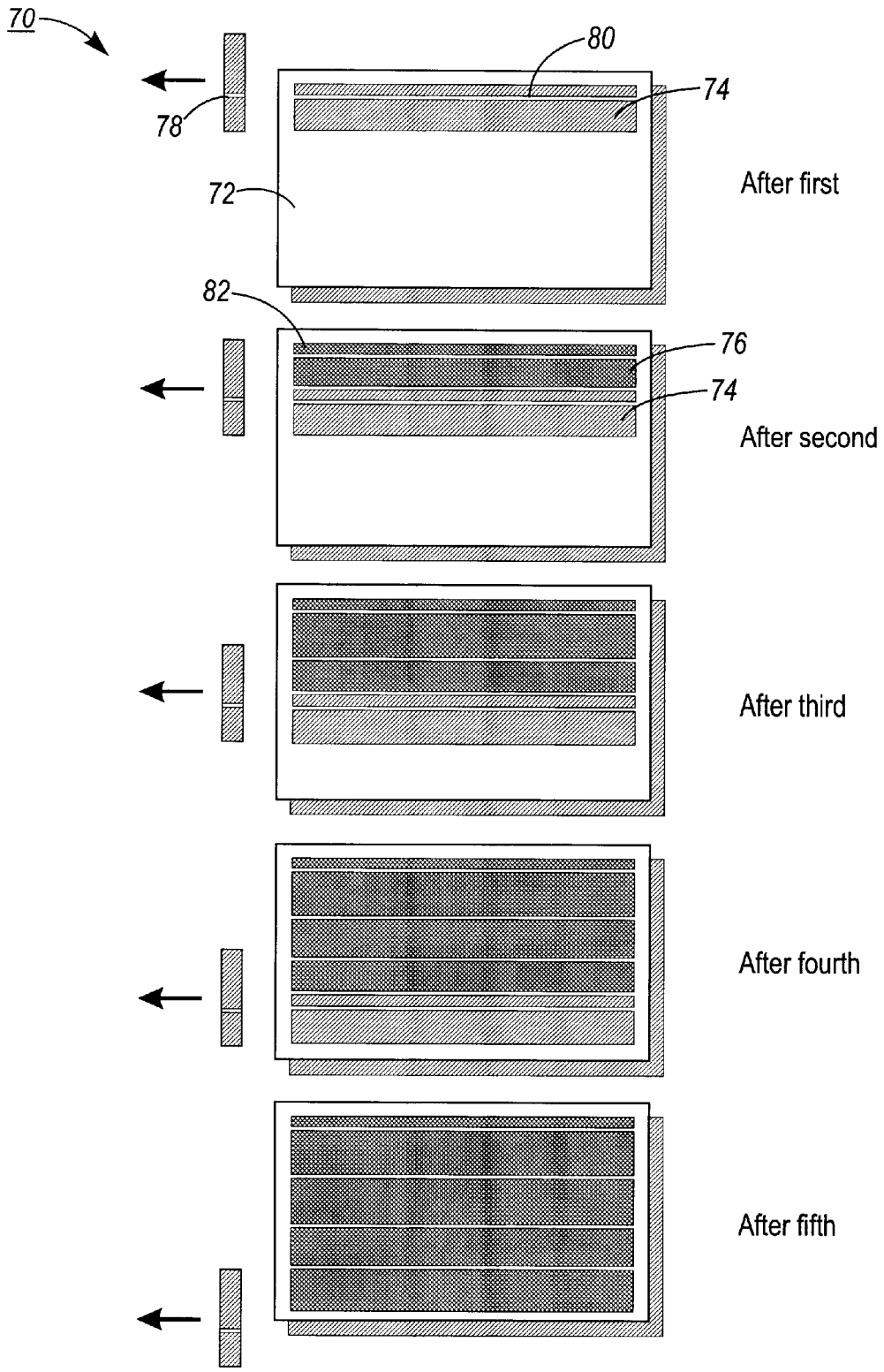
FIG. 7 illustrates an output of a printhead having a defective ejector.

In situations where there is a severe printhead signature such as shown in FIG. 7, additional image quality production techniques are required. In FIG. 7, printhead 70 is shown on the left having just completed scanning over a portion of a substrate 72. As the printhead 70 scans over the substrate 72, it supplies half of the maximum liquid 74 to each pixel during each pass. After each pass, the printhead 70 advances by half of the printhead length and then scans again. This brings half of the newly scanned area to fill density (shown in black) 76 as it had been addressed in the first pass, and the other half of the newly scanned area to partial density (shown in gray) 78.

The white line 78 in printhead 70 represents a defective ejector which results in a severe printhead signature, in this case a non-firing ejector. The non-active ejector 78 results in white line 80 in the gray image area 74 produced by a single pass of printhead 70. Subsequent passes of the printhead 70 can reduce the visual impact of this defect, as shown by the gray line 82 in black image area 76. After the third, fourth and fifth passes, the defect results in undesirable lines throughout the created image. As a general observation, a 0% ink line in a 50% or 100% ink field is significantly more noticeable to the human eye than a 50% ink line in a 100% ink field. Nevertheless, the defective ejector 78 results in an undesirable output image as shown after the fifth pass.

In order to diminish the effects of the defective printhead 78, the present embodiment identifies the ejector or ejectors in the printhead which are the source of the printhead signature severe enough to be uncorrectable via the diminished cross-talk process described above. Particularly, the printhead is tested to determine those ejectors which are defective such as to cause a severe printhead signature. Once the defective printhead is determined, look-up tables such as that of FIG. 1, are searched.

The look-up table (or other location in the system where the correlation between drop ejectors which will emit drops on a particular pixel are determined) is searched to find the correlating operative ejector that is paired with the defective ejector. Once the defective and operable ejectors are identified, the data presently configured (i.e. the firing sequences) for the defective ejector is transferred to the paired operable ejector. Since this operable ejector will not be able to provide the ink to the paper at the same time and location as the defective ejector, the data for driving the defective ejector is transferred to another pass of the printhead. This could be either to an earlier or later pass depending on the location of the defective ejector. The paired operable ejector is then operated at twice the drop repetition rate of its neighbors.

Figure 8:
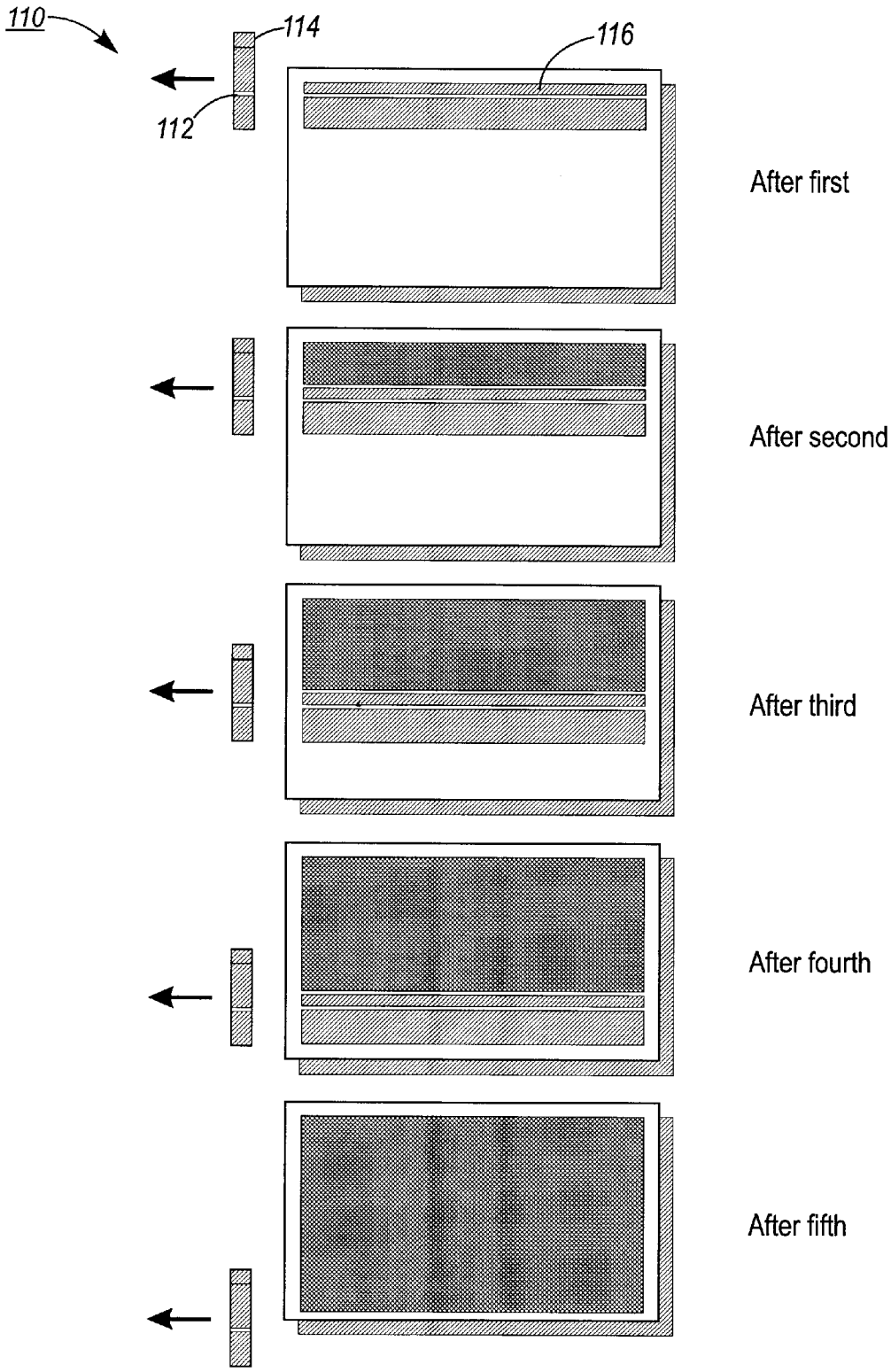
FIG. 8 sets forth operation of a printhead system configured having data of the defective printhead ejector transferred to the operable printhead ejector.

FIG. 8 illustrates a printhead 110 with two unique ejectors represented by non-gray lines. These ejectors are defective ejector white line 112 and operable paired ejector black line 114. Operable ejector 114 is located half of the print-width distance away from defective ejector 112. When printhead 110 advances to the next swath, the operable ejector 114 will then be in line with the location on the substrate having previously been passed over by the defective ejector 112. This results in operable ejector 114 ejecting droplets along the previously uncovered defective area 116.

As previously noted, the rate of addressing in these described embodiments has been increased from, for example, 24 kHz to 48 kHz. Further, algorithms/procedures used in forming the drop ejection sequences cause individual ejectors to be on for only half the period they would normally be on. However, under the present embodiment operable ejector 114, as it is attempting to make up for the defects of defective ejector 112, is made to operate at the higher rate, e.g., 48 kHz. It is noted that as the printhead 110 scans through the second through fifth passes, the defective white line caused by defective ejector 112 is covered due to the doubling of use of operable replacement ejector 114.

Figure 9:
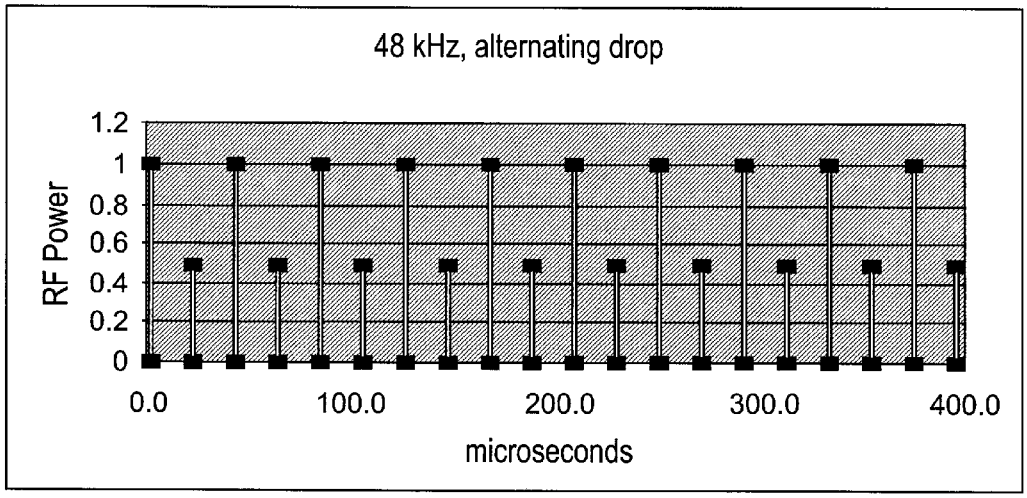
FIG. 9 depicts a chart representing power supplied to an operable ejector when it is not correcting errors.
Figure 10:
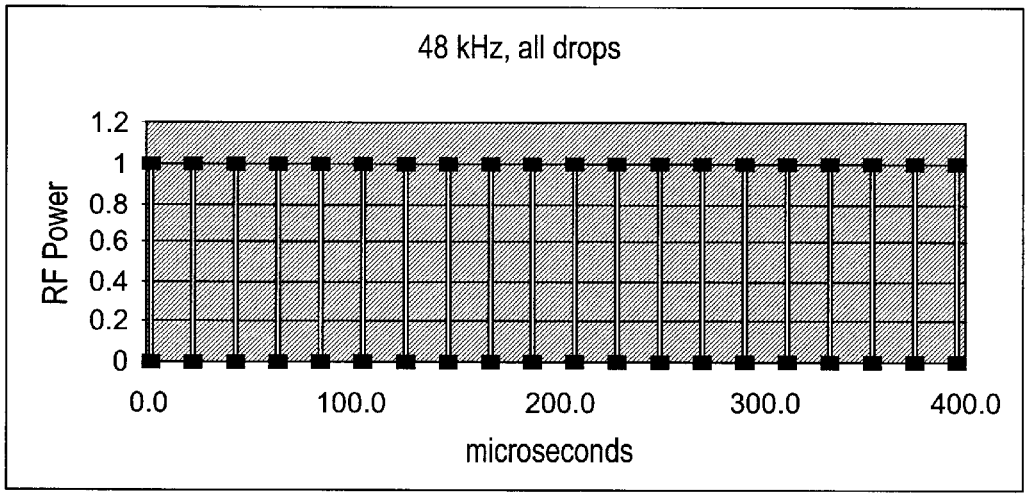
FIG. 10 depicts a chart representing power supplied to an operable ejector when it is correcting errors.

Turning to FIG. 9, illustrated is the power supplied to operable ejector 114 (of FIG. 8) when it is not operating to correct the errors created by defective ejector 112 (of FIG. 8). In this situation two microsecond pulses occur at a 48 kHz rate. The pulses alternate between a relative RF pulse amplitude of 1.0 which is required to eject a drop, and a relative RF pulse amplitude of 0.5 or lower when the row is being powered but the ejector is not ejecting a drop. Under this situation, only at every other pulse is a drop being ejected from ejector 114. On the other hand, turning to FIG. 10, illustrated is the power sent to operable ejector 114 when it is acting to correct the errors of the defective ejector 112. In this situation, doubling the frequency of the drop ejection requires that a relative RF pulse of 1.0 be enabled at 48 kHz for the operable ejector 114.

It is noted that doubling the frequency of the drop ejection for the operable ejector 114 at full power, i.e. 48 kHz, will in general lead to greater misdirectionality than its 24 kHz operation. However it has been determined by the inventors that such misdirectionality on a small number of ejectors results in a less noticeable artifact than caused by operation of the defective ejector.

Also, a further misdirectionality will occur as neighboring ejectors will be impacted by the operable ejectors operation at 48 kHz. While the adjacent or neighboring ejectors will not run at 48 kHz themselves, they will feel the influence of the acoustic cross-talk generated by the replacement ejector as it can be, in some situations, firing simultaneously with the adjacent ejectors. Again, while all this will have some detrimental affect on the directionality of the neighboring ejectors, it again has been determined by the inventors to be less noticeable than allowing the output from the defective ejector not to be corrected.

From the foregoing, it may be seen that numerous modifications and variations of the principals of the present invention will be obvious to those skilled in the art. Therefore, the scope of the present invention is to be defined by the appended claims.

Having thus described the preferred embodiments, what is claimed is:

1. In a droplet ejection system using a printhead having an array of ejectors arranged in rows and columns, where operation of each ejector is individually controllable, a method of minimizing cross-talk errors between ejectors adjacent to each other in a same row, the method comprising:

selecting first and third ejector in a selected row of the printhead;

identifying the first and third selected ejectors as one of odd or even ejectors of the selected row;

generating a first firing sequence for the first selected ejector based on the first selected ejector being identified as the one of odd or even;

selecting a second ejector in the selected row of the printhead, the selected row being the same row as the row of the first and third selected ejectors and the second ejector being adjacent the first ejector, and the third ejector being adjacent the second ejector;

identifying the second selected ejector as an odd or even ejector of the selected row;

generating a second firing sequence for the second selected ejector based on the second selected ejector being identified as odd or even; and generating a third firing sequence for the third selected ejector based on the third ejector being identified as one of odd or even, wherein the first, second and third firing sequences cause the first and third ejectors to be active when the second ejector is inactive, and the first and third ejectors to be inactive when the second ejector is active.

2. The method according to claim 1 further including:

selecting the selected row with a row addressing signal operating at a frequency approximately double a first frequency.

3. The method according to claim 1 wherein the steps of generating the first and the second firing sequences includes alternatingly adding non-operational states within a previously generated firing sequence, wherein the non-operational states of the first firing sequence are added at locations different from the non-perational states of the second firing sequence.

4. The method according to claim 1 further including operating the acoustic system as at least a two-pass system.

5. The method according to claim 1 wherein the number of the row addressing signals are greater in number than the number of row addressing signals used with the previously generated firing sequence.

6. The method according to claim 1 wherein the row addressing signal is approximately doubled from a first frequency, and the number of row addressing signals are doubled.

7. The method according to claim 1 wherein the ejectors eject at least one of bio-fluids or ink.

8. The method according to claim 1 wherein the system is a xerographic system.

9. In an at least two-pass droplet ejection system using printhead having an array of ejectors arranged in rows and columns, where operation of each ejector is individually controllable, such that during a first pass a first ejector ejects fluid on a substrate, at a selected location, and during a second pass a second ejector ejects fluid on the substrate at the selected location, a method of minimizing cross-talk errors between ejectors adjacent to each other in a same row, and minimizing errors of a defective ejector, the method comprising:

selecting first and second ejectors in a selected row of the printhead;

identifying the first and second selected ejectors as one of an odd or even ejectors of the selected row;

generating a first firing sequence for the first selected ejector based on the first selected ejector being identified as one of odd or even;

selecting a second ejector in the selected row, the second ejector being adjacent the first selected ejector and the second ejector being adjacent the second ejector;

identifying the second selected ejector in the selected row as one of an odd or even ejector of the selected row;

generating a second firing sequence for the second selected ejector of the selected row based on the second selected ejector being identified as one of odd or even;

generating a third firing sequence for the third selected ejector based on the third ejector being identified as one of odd or even, wherein the generated first, second and third firing sequences result in the first and third ejectors to be active when the second ejector is inactive, and the first and third ejectors to be inactive when the second ejector is active;

detecting a defective ejector of the array;

determining an operable ejector which is selected to eject fluid on the substrate at the same location as the defective ejector;

transferring a firing sequence originally intended to be used by the defective ejector such that it is used by the operational ejector;

activating the operable ejector for both its own firing sequence and the firing sequence of the defective ejector; and maintaining the defective ejector in a non-active state.

10. The method according to claim 9 further including, selecting the selected row with a row addressing signal operating at a frequency approximately double a first frequency.

11. The method according to claim 9 wherein the steps of generating the first and second firing sequences include alternatingly adding non-operational states within a previously generated firing sequence, wherein the non-operational states of the first firing sequence are added at locations different from the non-operational states of the second firing sequence.

12. The method according to claim 9 wherein the number of the row addressing signals are greater in number than the number of row addressing signals used with the previously generated firing sequences.

13. The method of claim 9 wherein in the at least two-pass acoustic printing system, the first ejector is configured to operate prior to intended operation of the second ejector.

14. The method of claim 9 wherein in the at least two pass acoustic printing system, the first ejector is configured to operate following intended operation of the second ejector.

15. The method of claim 9 further including:

operating the second ejector at a frequency greater than other ejectors of the array.

16. The method according to claim 9 wherein the ejectors eject at least one of bio-fluids or ink.

17. The method according to claim 9 wherein the system performing the method is a xerographic system.

18. The method according to claim 9 further including a step of permitting adjacent ejectors to operate simultaneously when one of the simultaneously operating ejectors has had the firing sequence of the defective ejector transferred to it.

* * * * *